US005151223A

United States Patent [19]

Maaser

[11] Patent Number: 5,151,223

[45] Date of Patent: Sep. 29, 1992

[54] LIQUID SOFTERGENT FORMULATIONS HAVING IMPROVED STABILITY AND SOFTENING PROPERTIES

[75] Inventor: Heidrun E. Maaser, Monmouth Junction, N.J.

[73] Assignee: Colgate-Palmolive Company, New York, N.Y.

[21] Appl. No.: 517,469

[22] Filed: Mar. 7, 1990

Related U.S. Application Data

[63] Continuation of Ser. No. 117,274, Nov. 5, 1987, abandoned.

[51] Int. Cl.[5] ..... C11D 1/62; D06M 13/46

[52] U.S. Cl. ..... 252/547; 252/8.6; 252/8.8; 252/544; 252/548; 252/173; 252/554; 252/555; 252/558; 252/559; 252/DIG. 1; 252/DIG. 14

[58] Field of Search ..... 252/8.6, 8.8, 8.75, 252/547, 544, 548, 555, 558, DIG. 1, DIG. 14

[56] References Cited

U.S. PATENT DOCUMENTS

| | | | |
|---|---|---|---|
| 4,134,838 | 1/1979 | Hooper et al. | 252/8.6 |
| 4,569,800 | 2/1986 | Stanley et al. | 252/8.8 |
| 4,675,118 | 6/1987 | Stanley et al. | 252/8.8 |

*Primary Examiner*—Prince Willis, Jr.
*Assistant Examiner*—John F. McNally
*Attorney, Agent, or Firm*—Bernard Liberman; Robert C. Sullivan

[57] ABSTRACT

Liquid softergent compositions having improved softening and stability properties comprising an anionic optical brightener, a higher alkyl dimethyl 2-ethyl hexyl quaternary ammonium compound, a nonionic surfactant and preferably an anionic surfactant in a 1:1 molar ratio with the cationic quaternary compound in an aqueous vehicle; and a method of simultaneously cleaning and softening fabrics without reducing brightener and detergency performance, which comprises treating fabrics with said composition in the wash cycle of the laundering operation.

13 Claims, No Drawings

LIQUID SOFTERGENT FORMULATIONS HAVING IMPROVED STABILITY AND SOFTENING PROPERTIES

This application is a continuation of application Ser. No. 07/117,274 filed Nov. 5, 1987, now abandoned.

BACKGROUND OF THE INVENTION AND PRIOR ART

The present invention relates to novel heavy duty softergent liquid compositions comprising at least 10% nonionic surfactant, and preferably about 6–9% of higher alkyl dimethyl 2-ethyl hexyl quaternary softening compound in conjunction with about 0.1–1% of an anionic optical brightener, to improve low temperature product stability and softening properties. It is preferable to add an anionic surfactant in the molar ratio of 1:1 anionic surfactant:cationic softening compound, and about 4–8% by weight of a lower mono- or di-hydric alcohol.

The use of cationic quaternary ammonium compounds as softeners for textile products is very well known in the art. It is also well known to employ such materials for their softening effects during the laundering operation and particularly in the rinse cycle of the laundering process. This latter technique has been necessitated by the fact that the aforesaid quaternary compounds heretofore employed, being mainly cationic in nature, form a complex with the anionic detergent, one of the major types of detergents used in the washing cycle. However, the use of the quaternary softening agent in the rinse cycle is burdensome to the consumer. Consequently, detergents have been combined with the compatible fabric softeners for use in the wash cycle of the laundering operation.

It is also known that the cationic softening compounds interfere with the brightening activity as well as the cleaning efficiency of the detergent. As a result, the prior art has used nonionic surfactants in order to overcome this interference with brightening activity and cleaning efficacy, as shown in U.S. Pat. Nos. 4,264,457; 4,239,659; 4,259,217, 4,222,905, etc.

Another problem associated with the presence of said cationic agents in liquid softergent compositions containing anionic optical brightener is product instability, particularly at low temperatures (about 40° F.), due to the tendency of the quaternary compounds to form a complex with the optical brightener which does not resolubilize in the aqueous media.

U.S. Pat. No. 4,134,838 discloses a fabric conditioning composition comprising a softening agent which include prior art cationic quaternary ammonium compounds such as di-tallow dimethyl ammonium chloride and trimethyl tallow ammonium chloride, and a deodorant perfume to which may be added water soluble detergent actives well known in the art such as anionic, nonionic, etc.; inorganic or organic detergent builders; optical brighteners; oils and fragrances; antistatic agents; germicides; bodying agents; soil release agents; ironing aids; bleaches; enzymes; etc. The conditioning compound may be in the form of a solid or liquid composition. The illustrated aqueous liquid fabric conditioning compositions contain a maximum of 6% by weight of the cationic softening agent (Example 1).

U.S. Pat. No. 4,341,644 discloses a textile softener composition comprising a quaternary ammonium salt mixture dispersed in an aqueous medium where the 4 radicals contain a total of 40–75% saturated aliphatic straight chains, 5–45% unsaturated aliphatic chains and 3–55% branched aliphatic chains.

European Patent No. 0,074,056 discloses a liquid softening/rinsing agent for laundry consisting of an aqueous solution or dispersion of a quaternary ammonium compound, wherein two of the radicals are methyl-branched alkyl or alkenyl radicals having 12–30 carbons, and the other two radicals are C1–C4 alkyl groups.

U.S. Pat. Nos. 4,569,800 and 4,675,118 discloses a fabric softening composition comprising a quaternary ammonium compound, wherein one radical is a higher aliphatic radical, another radical is 2-ethyl hexyl, and the remaining two radicals are methyl radicals, dissolved in ethanol, water, isopropyl alcohol and blends thereof.

However, none of the cited prior art references disclose a stable heavy duty liquid softergent composition for simultaneously cleaning and softening fabrics comprising a higher alkyl 2-ethyl hexyl dimethyl quaternary ammonium compound as the softening agent, an anionic optical brightener, at least 10% nonionic surfactant dissolved in an aqueous medium.

SUMMARY OF THE INVENTION

It has now been disclosed that the use of a C6–C18 alkyl 2-ethyl hexyl dimethyl quaternary ammonium salt as a softening agent in a liquid softergent composition comprising an anionic optical brightener and a nonionic or nonionic-anionic surfactant system provides product stability at low temperatures (40° F.) as well as at room temperature and provides increased softening properties to fabrics treated therewith. The advantage of this compound is that it improves low temperature stability of softergent formulations while softening as effectively or more so then a mono tallow trimethylammonium salt. Historically, softergents have been troubled by low temperature stability when quaternary ammonium salts were present in conjunction with anionic optical brighteners. This new quaternary alleviates this problem. Optical brighteners have a tendency to form complexes with quaternaries. It is believed that because of increased stearic hindrance in the ammonium salt, it is more difficult for any other anionic molecule to approach, thereby, slowing down or preventing complex formation. Low temperature instability is not seen until levels of brighteners and/or quaternary ammonium salt get to be quite high.

Accordingly, it is a primary object of the instant invention to provide a stable liquid softergent composition having improved softening efficacy in the presence of C6–C18 alkyl 2-ethyl hexyl dimethyl quaternary ammonium softening compounds.

Another object of the invention is to provide a stable heavy duty liquid softergent composition, that simultaneously cleanses and softens fabrics during the laundering process comprising an anionic optical brightener, a C6–C18 alkyl 2-ethyl hexyl dimethyl quaternary ammonium softening compound, and a nonionic surfactant in an aqueous medium.

Still another object of the invention is to provide a stable liquid softergent formulation having improved cleaning and fabric softening properties, due to the presence of a C6–C18 alkyl 2-ethyl hexyl dimethyl ammonium quaternary softening compound in a composition comprising an optical brightener, a nonionic surfactant, and preferably an anionic surfactant in a 1:1 molar ratio with said quaternary compound.

Additional objects, advantages and novel features of the invention will be set forth in part in the description which follows, and in part will become apparent to those skilled in the art upon examination of the following specification or may be learned by practice of this invention.

To achieve the foregoing and other objects in accordance with the present invention, as embodied and broadly described herein, the liquid softergent composition for laundering fabrics of this invention comprises an effective amount of a higher alkyl 2-ethyl hexyl dimethyl quaternary ammonium softening compound to provide product stability and softening properties in the presence of an anionic optical brightener, and a surfactant system comprising at least 10% by weight of a nonionic surfactant in an aqueous carrier, preferably containing about 4–8% by weight of a lower mono- or di-hydric alcohol; and the method of simultaneously cleansing and softening fabrics without reducing softening, brightener and detergency performance which comprises treating fabrics with said composition during the wash cycle of the laundering operation.

More specifically, present invention relates to a stable heavy duty liquid softergent composition comprising preferably about 6–9% by weight of a C6–C18 alkyl 2-ethyl hexyl dimethyl quaternary ammonium softening compound, about 0.1–1% by weight of an anionic optical brightener, a surfactant system comprising about 10–30% by weight of a nonionic surfactant, and preferably a lesser amount of an anionic surfactant preferably in a 1:1 molar ratio with said quaternary compound, in an aqueous vehicle, preferably containing about 4–8% by weight of a lower mono- or di-hydric alcohol. Although the most preferred molar ratio is 1:1 anionic to cationic, minor variations thereof may be used with large amounts of brightener to obtain stability properties.

DETAILED DESCRIPTION OF THE INVENTION

In accordance with this invention, the nonionic surfactants for use as the fabric detergent are commercially well known and include the ethoxylates and glycosides and mixtures thereof, such as the primary aliphatic alcohol ethoxylates, secondary aliphatic alcohol ethoxylates, alkylphenol ethoxylates, the alcohol ethylene oxide-propylene oxide condensates such as Plurafacs (Wyandotte), C1–30 alkyl monoglycosides and polyglycosides, and mixtures thereof. The nonionic synthetic organic detergents are generally the condensation product of an organic aliphatic or alkyl aromatic hydrophobic compound and hydrophilic ethylene oxide group, or a hydrophilic glycoside group containing 1 to about 10 saccharide radicals. Practically any hydrophobic compound having a carboxy, hydroxy, amido or amino group with a free hydrogen attached to the nitrogen can be condensed with ethylene oxide or with the polyhydration product thereof, polyethylene glycol, to form a nonionic detergent. Further, the length of the polyethenoxy chain can be adjusted to achieve the desired balance between the hydrophobic and hydrophilic elements.

The nonionic detergents include the polyethylene oxide condensate of one mole of alkyl phenol containing from about 6 to 12 carbon atoms in a straight -or branched-chain configuration with about 5 to 30 moles of ethylene oxide, for example, nonyl phenol condensed with 9 moles of ethylene oxide, dodecyl phenol condensed with 15 moles of ethylene oxide. Condensation products of the corresponding alkyl thiophenols with 5 to 30 moles of ethylene oxide are also suitable.

Also included in the nonionic detergent class are the condensation products of a higher alcohol (e.g. an alkanol containing about 8 to 18 carbon atoms in a straight or branched-chain configuration) condensed with about 4 to 30 moles of ethylene oxide, for example, lauryl-myristyl alcohol condensed with about 16 moles of ethylene oxide. A commercially available preferred group is the narrow range ethoxylate nonionics known as Tergitol provided by Union Carbide, wherein the ethylene oxide chain (including the terminal ethanol) is of such narrow distribution that at leas 80% and preferably 85–90% of the nonionic detergent contains an average of 4–12 and preferably 6–7 ethylene oxides.

The alkyl glycosides may be represented by the following formula, $RO(R'O)_{xZn}$, wherein R is a C1–C30 alkyl radical, (R'O) is an ethoxy, propoxy or glyceryl group, X has a numerical value of 0–10 and preferably O, Z is a reducing saccharide containing 5 or 6 carbon atoms, and n has a numerical value of 1–10 and preferably 1 to 3. The hydrophobic alkyl group may be saturated or unsaturated, branched or straight chain, preferably saturated and linear, containing 1 to 30 carbon atoms, preferably 8 to 23 carbon atoms. Suitable alkyl polyglycosides include methyl, ethyl, propyl, octyl, nonyl, decyl, undecyl, dodecyl, tridecyl, tetradecyl, hexdecyl, heptadecyl, octadecyl and mixtures thereof, monoglycosides, diglycosides, triglycosides, tetraglycosides, penta-glycosides, hexaglycosides, etc. The glycoside units may be glucose, galactose, mannose, lactose and/or fructose. Methods of preparing the foregoing glycosides are disclosed in U.S. Pat. Nos. 3,598,865; 3,707,535; 3,839,318; 3,772,269; 3,219,656, all of which are incorporated herein by reference.

Another preferred group of nonionic surfactants are the Neodol ethoxylates (Shell Co.), which are higher aliphatic alcohol ethoxylates having about 5 to 20 ethylenoxy groups per mole of aliphatic alcohol containing about 10–18 carbon atoms, such as $C_{12}$–$C_{13}$ alkanol condensed with 6.5 moles ethylene oxide, C12–C15 alkanol condensed with 12 moles ethylene oxide, C14–C15 alkanol condensed with 13 moles ethylene oxide, and the like.

It has been found that the nonionic surfactants improve oily soil detergency and provide low temperature (40° F.) stability to the softergent composition. Ethoxamers having a HLB (hydrophobic lipophilic balance) value of about 8–15 gives good O/W emulsification, whereas ethoxamers with low HLB values (Below 8) contain less than 5 ethylenoxy groups, and are poor emulsifiers and poor nonionic detergents. The amount of nonionic detergent constitutes the major detergent component in this softergent, about 10–30% and preferably 15–25% by wt. of the composition.

The anionic surfactants, which are optionally preferred in the softergent of this invention, are commercially well known and include alkylbenzene-sulfonic acid and its salts, e.g. compounds of the formula alkylphenol —SO —M, wherein alkyl is an alkyl radical of $C_8$ to $C_{22}$ and preferably $C_{10}$ to $C_{18}$ and M is hydrogen or an alkali metal, which compounds comprise a well-known class of anionic detergents and include sodium dodecyl benzene sulfonate, potassium dodecylbenzenesulfonate, sodium laurylbenzenesulfonate, sodium cetyl-benzene sulfonate. Others include paraffin sulfonates, alkyl sulfates, alcohol ether sulfates, olefin sulfonates and the alkylphenolethoxylate sulfates (e.g. sodium, dinonylphenoxynonaethoxyethanol sulfate), and other equivalent water-soluble salts, particularly of the alkali metal series.

Among the above-noted alkylbenzene-sulfonic acid and salts thereof, the preferred compounds include those which are biodegradable and which are particularly characterized by a linear alkyl substituent of from $C_{10}$ to $C_{22}$ and preferably from $C_{12}$ to $C_{15}$. It is, of course, understood that the carbon chain length represents, in general, an average chain length since the method for producing such products usually employs alkylating reagents of mixed chain length. It is clear, however, that substantially pure olefins as well as alkylating compounds used in other techniques can and do give alkylated benzene sulfonates wherein the alkyl moiety is substantially (i.e., at least 99%) of one chain length, i.e., C2 to C12, C13, C14 or C15. The linear alkyl benzene sulfonates are further characterized by the position of the benzene ring in the linear alkyl chain with any of the position isomers (i.e., alpha to omega) being operable and contemplated.

In addition to the benzene sulfonates one may also employ the lower alkyl ($C_1$ to $C_4$) analog of benzene such as toluene, xylene, the trimethyl benzenes, ethyl benzene, isopropyl benzene and the like. The sulfonates are generally employed in the water soluble salt form which include as the cation, the alkali metals, ammonium and lower amine, and alkanolamine cations.

Examples of suitable linear alkyl benzene sulfonates include:

sodium n-decyl benzene sulfonate
sodium n-dodecyl benzene sulfonate
sodium n-tetradecyl benzene sulfonate
sodium n-pentadecyl benzene sulfonate
sodium n-hexadecyl benzene sulfonate and the corresponding lower alkyl substituted homologues of benzene as well as the salts of the cations previously referred to. Mixtures of these sulfonates may, of course, also be used with mixtures which may include compounds wherein the linear alkyl chain is smaller or larger than indicated herein provided that the average chain length in the mixture conforms to the specific requirements of $C_{10}$ to $C_{22}$.

The linear paraffin sulfonates are also a well-known group of compounds and include water-soluble salts (alkali metal, amine, alkanolamine, and ammonium) of:

1-decane sulfonic acid
1-dodecane sulfonic acid
1-tridecane sulfonic acid
1-tetradecane sulfonic acid
1-pentadecane sulfonic acid
1-hexadecane sulfonic acid as well as the other position isomers of the sulfonic acid group.

In addition to the paraffin sulfonates illustrated above, others with the general range of $C_{10}$ to $C_{22}$ alkyl may be used, with the most preferable range being from C12 to C20.

The linear alkyl sulfates which are contemplated in this invention comprise the range of C10 to C20. Specific examples include sodium n-decyl sulfate; sodium n-dodecyl sulfate; sodium n-hexadecyl sulfate, sodium n-heptadecyl sulfate; sodium n-octadecyl sulfate; and the ethoxylated (1 to 100 moles ethylene oxide) derivatives such as the ethoxylated alcohol sulfate and, of course, the other water-soluble salt-forming cations mentioned above.

Included in the group of anionic detergents, which have been described above as suitable in the present invention, are the olefin sulfates, including long chain alkene sulfonates, long chain hydroxyalkane sulfonates, as well as disulfonates. Examples of suitable olefin, which are merely illustrative of the general class, are sodium dodecenyl-1 sulfonate, sodium tetradecyl-1 sulfonate, sodium hexadecenyl-1 sulfonate, and sodium octadecenyl-1 sulfonate. The amount of anionic surfactant utilized in present composition is less than the nonionic surfactant content by wt, and preferably in a 1:1 molar ratio with the cationic quaternary softening agent, and constitutes the 3.8–7% by wt. of the softergent composition.

The presence of the anionic surfactant in the formulation enhances detergency performance and brightening efficacy by depositing the brightener on the fabric more effectively.

The essential ingredient in the instant liquid softergent is the cationic fabric softener which is an alkyl 2-ethyl hexyl dimethyl quaternary ammonium compound represented by the following formula:

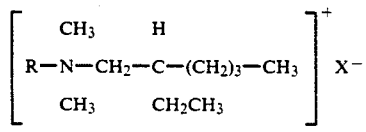

wherein R is an aliphatic straight chain, saturated and unsaturated hydrocarbon radical having from 6 to 18 carbon atoms, and X is a water soluble salt forming anion such as halide, i.e. chloride, bromide, iodide; sulfate, methosulfate, ethosulfate, citrate, acetate, hydroxide, phosphate, or similar inorganic or organic solubilizing radical. Preferably, the R radical is obtained from a mixture of long chain fatty acids such as the tallow or coco radicals. The tallow radical is a mixture of aliphatic saturated and unsaturated hydrocarbon radicals containing a major amount of 16 to 18 carbon chains and a minor amount of 12 to 14 carbon chains. The coco radical is a mixture of saturated and unsaturated hydrocarbon radicals containing a major amount of 12 to 14 carbon chains and a minor amount of 6 to 10 and 16 to 18 carbon chains. Hydrogenated tallow is another preferred long chain radical. Other suitable radicals include stearyl, cetyl, lauryl, dodecyl, octadecyl, myristyl and hexadecyl and mixtures thereof. Methods of preparing the aforesaid quaternary ammonium compounds are disclosed in U.S. Pat. Nos. 4,569,800 and 4,675,118, both of which are incorporated herein by reference. Aforesaid alkyl 2-ethyl hexyl dimethyl quaternary ammonium softening compounds is preferably used at levels of 6–9% by weight of the liquid softergent but may be used at 3–4% levels provided effective softening properties are obtained. However, prior art quaternary softeners are conventionally used at concentrations of 3%. The branched alkyl radical, 2-ethyl hexyl, provides the quaternary compound with greater solubility in the aqueous alcoholic medium.

It has now been found that these quaternary ammonium softening compounds improve low temperature stability of the softergent compositions. This may be due to the low cloud point of the softening compound which is directly related to its clarity at a given temperature. The cloud point of hydrogenated tallow 2-ethyl hexyl dimethyl quaternary ammonium chloride is 27° F., and cocoalkyl 2-ethylhexyl dimethylammonium chloride has a cloud point of −10° F.

The stability of the liquid softergent is also a function of the amount of the quaternary compound in relation to the anionic optical brightener content. A greater quantity of quaternary compound requires a lesser amount of brightener. The anionic optical brighteners have a tendency to form a complex with the cationic quaternaries in an aqueous medium. However, due to the stearic hindrance in the higher alkyl 2-ethyl hexyl dimethyl ammonium salt, it is more difficult for any anionic molecule to approach the cationic ammonium salt, thereby slowing down or preventing complex formation. The use of these particular quaternary ammonium compounds obviates the long standing low temperature instability problem associated with compositions containing both a quaternary compound and an anionic optical brightener. Fabric softening, brightening and detergency properties as well as stability of the liquid compositions has been achieved.

Another essential ingredient in present liquid softergent is an anionic optical brightener having a sulfonate moiety such as substituted disulphonated diaminostilbene and triazole compounds to provide brightness to the washed fabric, a feature found desirable to consumers. Optical brighteners are substantive to textiles during the laundering process and sometimes are of comparatively low solubilities. Accordingly, it is important that they be maintained in solution in the liquid softergent composition and readily dispersed in the wash water in order to produce a uniformly bright appearance. Relatively small quantities of brighteners should be used so as not to exceed the limits of solubility. However, the presence of a cationic quaternary softening compound forms a complex with the anionic optical brightener causing low temperature instability of the liquid composition. Due to the increased stearic hindrance in the particular ammonium salt used in present softergent composition, it is more difficult for the anionic molecule to approach, thereby slowing down or preventing complex formation. Certain brighteners have been found to readily dissolve in an aqueous medium and thus are suitable for incorporation in present liquid softergent. Fortunately, these preferred brighteners include both cotton and amide-polyester-brighteners. Accordingly, suitable commercial brighteners are used in present liquid softergents including Tinopal UNPA, Tinopal CBS, Tinopal 5BM(Ciba-Geigy), Arctic White CC, Arctic White CWD (Hilton Davis), and the following Phorwhites from Verona: BHC, BKL, BUP, BBH solution, BRV solution, DCR liquid, DCBVF, EV liquid, DBS liquids and ANR.

The anionic optical brightener content of the liquid softergent composition is about 0.1–1%, and preferably about 0.4–0.8% by weight of the composition. Said concentrations are soluble in the present liquid softergents and are effective in brightening the washed laundry.

The liquid vehicle or carrier for the present liquid softergent composition is primarily an aqueous medium. It is preferable to add about 4–8% by weight of a lower alkyl mono-or di-hydric alcohol such as ethanol, propanol, isopropanol, butanol, isobutanol, ethylene glycol, propylene glycol or the like, to control the viscosity of said clear liquid softergent composition, when necessary or desirable.

The softergent composition of the instant invention may also include minimal amounts up to 5% by weight of conventional laundering additives such as germicides, soil suspending agents, antiredisposition agents, coloring materials (dyes and pigments), perfumes, hydrotropes such as sodium and potassium xylene sulfonates, sodium and potassium toluene sulfonates, cumene sulfonates, ethyl benzene sulfonate and the like, enzymes, and enzyme stabilizers, provided they do not interfere with the stability, brightness, detergency and softening activity of the composition.

The present liquid softergent compositions may be prepared by simply admixing the various ingredients at room temperature, in an aqueous medium until a clear liquid is formed. The order of addition of the ingredients may be varied without adversely affecting the formation of the single phase, clear liquid products of instant invention.

The softergent composition of the present invention exhibits many desirable characteristics with regard to both physical properties and performance in use. More specifically the liquid compositions are clear, pourable and free-flowing from any suitable container. They are stable upon aging at room temperature (about 70° F.) as well as at low temperatures (40° F.), without any appreciable precipitation or cloudiness. The present softergents simultaneously and effectively clean, soften and control the static of the different fabrics during the wash cycle of the laundering operation.

The following specific examples are merely illustrative of the invention and are not to be construed as limiting thereof.

EXAMPLE 1

Liquid Softergent

| Ingredients | % |
|---|---|
| C12–C15 Alcohol: 7EO (ethylene oxide) | 21.0 |
| Dodecylbenzene sulfonate (DBS) | 3.8 |
| Tallow alkyl 2-ethyl hexyl dimethyl ammonium methyl sulfate (TL8-MS) | 6.0 |
| Tinopal UNPA* | 0.4 |
| Ethanol | 6.0 |
| Sodium xylene sulfonate (SXS) | 5.0 |
| Water | q.s. |

*CAS Registry No. 4193-55-9-2,2'-(1,2-ethenediyl)bis(5-((4-(bis(2-hydroxyethyl-)amino)-6-(phenylamino)-1,3,5-triazin-2-yl)amino)-benzene sulfonic acid, disodium salt.

This composition is prepared by mixing the above water soluble ingredients until a homogeneous, clear liquid softergent is formed which is stable at room temperature and at 40° F.

This formulation was tested after 5 wash-dry cycles using terry hand towels for softness and antistatic properties. Table I compares compositions containing the prior art monotallow trimethyl ammonium chloride softening agent in lieu of the tallow 2-ethyl hexyl dimethyl ammonium methyl sulfate softening agent in Example 1, using liquid Bold (containing ditallow dimethyl ammonium chloride) as the control having the greatest softness (9.5).

Table I lists the comparative softness rating which is within a range of 1 (hardest) to 10 (softest), and the comparative antistatic rating wherein the control exhibits no static.

TABLE I

| Product | Softening | Antistatic |
|---|---|---|
| Example 1 | 8.0 | None |
| Monotallow trimethyl ammonium chloride | 5.0 | Very light |
| Control | 9.5 | None |

The rating description for the antistatic is as follows:
None-no noise/no cling
Very light-1 or 2 items sticking together or 1 type of fabric clinging Example 1 was ranked equal in softness to liquid Bold at the 99% confidence level. The softness Ranking procedure is as follows: A panel of twenty subjects was asked to rank from harshest to softest, terry hand towels washed 5 times in the products being tested. More than one product can be ranked in the same position. The results are analyzed by Friedman two way non parametric statistical methods, M. Hollander and D. A. Wolf, J. Wiley and Sons, 1973, page 13. The test conditions are a temperature of 72° F. and a humidity of 50%.

The detergency of this product was also tested in a tergotometer containing 1 liter of 150 ppm (calcium) water at 120° F. and 70° F., with a concentration of 0.18% softergent, and compared to commerical detergent products which contain different quaternary ammonium softening compounds. A fabric load of standard soiled swatches of Test Fabric nylon (TFN) and cotton (TFC), a 65-35% blend of polyester-cotton (PC) and 50:50% dacron:cotton (DC) and EMPA 101 Cloth, was washed with the test softergents and dried in electric tumble dryers. Reflectance of the soiled swatches are read as a measure of detergency (Rd.) The soil removal (SR) is the sum total of the Rd readings on all the swatches, and the soil removal index (SRI) is the average of the total Rd readings divided by the number of swatches.

TABLE II

| | | SRI | |
|---|---|---|---|
| | Ex. 1 | Liquid Fab | Liquid Bold |
| 120° F. | 200 | 219 | 189 |
| 70° F. | 201 | 205 | 183 |

Example 1 exhibits superior detergency to liquid Bold. No statistically significant difference in detergency was observed between Example 1, and Liquid Fab at 120° F. and 70° F. The difference observed at 120° F. was due to a better performance of liquid Fab on TFN and TFC fabrics. However, performance on PC cotton, DC and EMPA were equivalent.

A five week bundle test tested the Example 1 formulation against liquid Bold. On Whites, Example 1 showed a strong win over liquid Bold visually with a preference ratio of 2.74. On cotton, Example 1 showed enhanced performance relative to liquid Bold as measured instrumentally. Rd values for cotton for the two products were not significantly different. On colors, Example 1 was visually preferred over liquid Bold at a ratio of 1.5. No significant difference was detected instrumentally. Liquid Bold showed a strong win on whites and cottons with respect to softness. Static cling evaluation showed liquid Bold to have none and Example 1 to have slight to none.

Multistain tests on oily particulate, dry particulate, oxidizable and enzyme stains conducted with the liquid softergents of present invention in the washing machine at 70° F., 120° F. and 150 ppm water hardness, gave favorable results.

| | Examples 2-9 | | | | | | | |
|---|---|---|---|---|---|---|---|---|
| Ingredients | 2 % | 3 % | 4 % | 5 % | 6 % | 7 % | 8 % | 9 % |
| C12-15 Alcohol 7EO | 21 | 21 | 21 | 21 | 21 | 21 | 21 | 21 |
| TL8-MS | 6 | 6 | 6 | 6 | 6 | 6 | 6 | 6 |
| Tinopal UNPA | 0.1 | 0.2 | 0.3 | 0.4 | 0.5 | 0.6 | 0.8 | 1.0 |
| DBS | 3.8 | 3.8 | 3.8 | 3.8 | 3.8 | 3.8 | 3.8 | 3.8 |
| Ethanol | 6.0 | 6.0 | 6.0 | 6.0 | 6.0 | 6.0 | 6.0 | 6.0 |
| SXS | 5.0 | 5.0 | 5.0 | 5.0 | 5.0 | 5.0 | 5.0 | 5.0 |
| H2O | | | | balance | | | | |
| Aging time | 4 weeks | 4 | 4 | 4 | 4 | 4 | 2 | 2 |
| Stability | clear | clear | clear | clear | clear | clr. | clr. | slight precipitate recovers at rt. |

These examples clearly show that 0.1 to a maximum of 1% optical brightener can be used in a liquid softener containing the particular quaternary ammonium softening compounds set forth herein and an anionic surfactant in a 1:1 molar ratio, without interfering with the stability of the softergent product. This eliminates the need to limit the brightener content to a minimal amount of about 0.3% or less in order to avoid or prevent instability and the loss of brightening properties.

| | Examples 10-18 | | | | | | | | |
|---|---|---|---|---|---|---|---|---|---|
| Ingredients | 10 % | 11 % | 12 % | 13 % | 14 % | 15 % | 16 % | 17 % | 18 % |
| C12-15 alcohol 7EO | 21 | 21 | 21 | 21 | 21 | 21 | 21 | 21 | 21 |
| TL8-MS | 6 | 6 | 6 | 6 | 6 | 6 | 6 | 6 | 6 |
| Tinopal UNPA | 0 | 0.4 | 0.8 | 0 | 0.4 | 0.8 | 0 | 0.4 | 0.8 |
| DBS | 5.0 | 5.0 | 5.0 | 6.0 | 6.0 | 6.0 | 7.0 | 7.0 | 7.0 |
| Ethanol | 6.0 | 6.0 | 6.0 | 6.0 | 6.0 | 6.0 | 6.0 | 6.0 | 6.0 |
| SXS | 5.0 | 5.0 | 5.0 | 5.0 | 5.0 | 5.0 | 5.0 | 5.0 | 5.0 |
| H2O | | | | | balance | | | | |
| Aging time (weeks) | 4 | 4 | 4 | 4 | 2 | 4 | 2 | 2 | 2 |
| Stability | failed cloudy | clr. | clr. | failed cloudy oily | OK | clr. | fld. | fld. | fld. |

These examples clearly show that a greater amount of anionic surfactant (Ex 16, 17 and 18) than the cationic quaternary ammonium compound content, adversely affects the stability of the composition. It is further shown herein that the presence of the optical brightener is a necessary ingredient in the present softergent composition in order to provide stability to the liquid product. The absence of the optical brighteners in Examples 10, 13 and 16 resulted in instability.

| | Examples 19–27 | | | | | | | | |
|---|---|---|---|---|---|---|---|---|---|
| Ingredients | 19 % | 20 % | 21 % | 22 % | 23 % | 24 % | 25 % | 26 % | 27 % |
| C12–15 Alcohol | 21 | 21 | 21 | 21 | 21 | 21 | 21 | 21 | 21 |
| TL8-Ms | 7.0 | 7.0 | 7.0 | 8.0 | 8.0 | 8.0 | 9.0 | 9.0 | 9.0 |
| Tinopal UNPA | 0.4 | 0.6 | 0.8 | 0.4 | 0.6 | 0.8 | 0.4 | 0.6 | 0.8 |
| DBS | 3.8 | 3.8 | 3.8 | 3.8 | 3.8 | 3.8 | 3.8 | 3.8 | 3.8 |
| Ethanol | 6.0 | 6.0 | 6.0 | 6.0 | 6.0 | 6.0 | 6.0 | 6.0 | 6.0 |
| SXS | 5.0 | 5.0 | 5.0 | 5.0 | 5.0 | 5.0 | 5.0 | 5.0 | 5.0 |
| H2O | | | | | balance | | | | |
| Aging time | 4 | 4 | 2 | 2 | 2 | 2 | 2 | 2 | 2 |
| stability | clr. OK | clr. OK | clr. OK | oily phase | oily | oily | oily | oily cldy. | oily cloudy |
| | | | | | | not stable | | | |

These examples show that the alkyl 2-ethyl hexyl dimethyl quarternary ammonium compound can be used in a liquid softergent composition in an amount in excess of 6% by weight, provided a molar ratio of about 1:1 anionic quaternary is present, contrary to the prior art usage of a quaternary softening agent in an amount of about 4% by weight, without interfering with the stability of the composition (Examples 19, 20 and 21). There was an insufficient amount of anionic surfactant with reference to the amount of the quaternary compound in Examples 22–27. Compositions containing 0.6% by weight of brightener and 7.0% by weight quaternary are stable at 40° F. up to 4 weeks.

Sometimes an oily phase is seen if excess anionic is present, not because of an interaction with quat and brightener, but rather because of interaction with quat and anionic. A theoretical model of solution thereof envisions an equilibrium between monomer, micelle and precipitate (cationic-quat-and anionic-surfactant-). At high enough levels of one species, micelles form, thereby reducing the free monomer available. This makes the monomer unavailable for complexing with the oppositely charged species. The theoretical model is only inadequate in a region when coacervate forms (a type of gel or oily phase). This is what we see when an oily phase develops on aging when excess anionic or quat is present. This instability is not caused by quat brightener interaction, presumably. That is why one should stay as close as possible to 1:1 molar ratio. If this ratio is observed, then, the amount of brightener can probably be pretty high, also the quat; but the anionic has to go up correspondingly.

A comparison of the low temperature stability of compositions containing a tallow 2-ethyl hexyl dimethyl ammonium compound or the monotallow trimethyl quaternary of the prior art is set forth in Table III.

TABLE III

| Low Temperature Stability | | |
|---|---|---|
| % | Brightener % | Stability at 40° F. % |
| Tallow 2-ethylhexyl quat | | |
| 6.0 | 0.4 | Passed |
| 6.0 | 0.8 | Passed |
| 7.0 | 0.4 | Passed |
| 7.0 | 0.6 | Passed |
| Tallow trimethyl quat | | |
| 6.5 | 0.2 | Passed |
| 6.5 | 0.3 | Failed |
| 7.0 | 0.2 | Passed |

TABLE III-continued

| Low Temperature Stability | | |
|---|---|---|
| % | Brightener % | Stability at 40° F. % |
| 7.0 | 0.3 | Failed |

This table clearly shows the superior stability using greater levels of brightener of present novel compositions, heretofore unobtainable.

It is understood that the foregoing detailed description is given merely by way of illustration and that variations may be made therein without departing from the spirit of the invention. The "Abstract" given above is merely for the convenience of technical searchers and is not to be given any weight with respect to the scope of the invention.

I claim:

1. A stable, liquid, softergent composition which simultaneously cleans, softens and controls the static of fabrics washed therewith in the wash cycle of the laundering process without reducing brightener and detergency performance comprising, by weight, about 10% to 30% of a nonionic surfactant; about 6% to 9% of a C6–C18 alkyl 2-ethyl hexyl dimethyl quaternary ammonium softening agent; 3.8% to 7% of a sulfated or sulfonated anionic surfactant, the molar ratio of said anionic surfactant to said cationic softener being about 1:1; and about 0.1% to 1% of an anionic optical brightener having a sulfonate moiety in its structure solubilized in an aqueous vehicle, said composition being stable and clear upon aging at 21° C. and 5° C.

2. The composition according to claim 1 wherein the aqueous vehicle contains in addition about 4–8% by weight of a lower mono- or di-hydric alcohol.

3. The composition of claim 2 wherein said nonionic surfactant is present in an amount of 15% to 25% by weight and said anionic brighter is present in an amount of 0.4% to 0.8% by weight.

4. The composition according to claim 3 wherein said nonionic surfactant is selected from the group consisting of primary aliphatic alcohol ethoxylates, secondary aliphatic alcohol ethoxylates, alkylphenol ethoxylates, alcohol ethylene oxide-propylene oxide condensates, C1–C30 alkyl mono-glycosides and polyglycosides and mixtures thereof and said anionic surfactant is selected from the group consisting of alkylbenzene sulfonates, olefin sulfonates, paraffin sulfonates, alkyl sulfates and alkyl ethenoxy ether sulfates.

5. The composition according to claim 1 wherein the nonionic surfactant is selected from the group consisting of primary aliphatic alcohol ethoxylates, secondary aliphatic alcohol ethoxylates, alkylphenol ethoxylates, alcohol ethylene oxide-propylene oxide condensates, C1–30 alkyl mono-glycosides and polyglycosides, and mixtures thereof.

6. The composition according to claim 5, wherein the nonionic surfactant is a C12–C15 aliphatic alcohol having 7 ethyleneoxy groups per mole of alcohol.

7. The composition according to claim 1 wherein the anionic surfactant is selected from the group consisting alkylbenzene sulfonates, olefin sulfonates, paraffin sulfonates, alkyl sulfates and ethoxylatd alcohol sulfates.

8. The composition according to claim 7, wherein the anionic surfactant is dodecylbenzene sulfonate.

9. The composition according to claim 1, wherein the quaternary compound is tallow alkyl 2-ethylhexyl dimethyl ammonium methyl sulfate.

10. The composition according to claim 1, which comprises 0.6% by weight brightener and 7.0% by weight quaternary compound.

11. The composition according to claim 1, which comprises 3.8% by weight anionic surfactant, 6.0% by weight quaternary compound, 0.4% by weight anionic optical brightener, and 21% nonionic surfactant.

12. The composition according to claim 1, which comprise 6% quaternary compound, 5–6% anionic surfactant and 0.4–0.8% optical brightener.

13. A method of simultaneously cleaning and softening fabrics without reducing softening, brightener and detergency performance which comprises contacting soiled fabrics with the composition of claim 1, in the wash cycle of the laundering process.

* * * * *